United States Patent [19]

Beyl

[11] 4,135,735

[45] Jan. 23, 1979

[54] SAFETY SKI BINDING WITH BOOT-CLAMPING MOVABLE PLATE

[76] Inventor: Jean J. A. Beyl, 10, Blvd. Victor Hugo, Nevers, Nievre, France

[21] Appl. No.: 765,819

[22] Filed: Feb. 4, 1977

[30] Foreign Application Priority Data

Feb. 18, 1976 [FR] France ..... 76 04385

[51] Int. Cl.[2] ..... A63C 9/08

[52] U.S. Cl. ..... 280/618; 280/629; 280/634

[58] Field of Search ..... 280/618, 629, 630, 628, 280/627, 626, 623, 611, 634, 633

[56] References Cited

U.S. PATENT DOCUMENTS

| | | | |
|---|---|---|---|
| 3,458,211 | 7/1969 | Marker et al. | 280/626 |
| 3,462,165 | 8/1969 | Brunner | 280/630 |
| 3,489,424 | 1/1970 | Gertsch et al. | 280/618 |
| 3,612,559 | 10/1971 | Peterson et al. | 280/628 |
| 3,838,866 | 10/1974 | D'Alessio et al. | 280/613 X |
| 3,866,928 | 2/1975 | Gertsch et al. | 280/618 |

FOREIGN PATENT DOCUMENTS

| | | | |
|---|---|---|---|
| 1225426 | 2/1960 | France | 280/626 |

*Primary Examiner*—Joseph F. Peters, Jr.
*Assistant Examiner*—Milton L. Smith
*Attorney, Agent, or Firm*—Bierman & Bierman

[57] ABSTRACT

A safety ski binding includes a movable boot supporting plate detachably secured to a ski. A retaining bolt mounted on the ski for both longitudinal and pivotal movement engages a recess or ramp formed on one end of the plate and is held against movement by a spring biased piston engaging a camming surface mounted on the bolt or the ski with the piston mounted on the other of the bolt or the ski. The other end of the plate is held to the same by any suitable device. The contour of the camming surface determines the value of the resilient resistance holding the bolt against movement.

8 Claims, 11 Drawing Figures

SAFETY SKI BINDING WITH BOOT-CLAMPING MOVABLE PLATE

BACKGROUND OF THE INVENTION

1. Field of the Invention

The present invention relates to safety ski bindings comprising a movable plate adapted to clamp the relevant ski boot, and detachably secured to the ski by retaining means engaging the toe and heel ends of the ski boot.

One of said retaining means has a somewhat passive function. The other retaining means comprises a movable retaining bolt associated with a resilient locking mechanism and adapted to engage a notch or cavity formed at the registering end of said movable plate.

The arrangement is such that the resilient locking mechanism is capable of holding the plate against any movement when efforts of limited magnitude and duration are exerted thereagainst, while permitting on the other hand the withdrawal of said retaining bolt in order to release said plate when abnormally high efforts are exerted on the skier's leg or foot. However, this plate should advantageously be released not only in case of torsional stresses tending to rotate the plate in a plane parallel to the top surface of the ski but also in case of upward straining or stretching efforts tending to tilt the plate forwards or backwards. It is also necessary that this release can take place in case of compound movements involving a rotational movement combined with a stretching movement.

2. Description of the Prior Art

In certain known devices of relatively simple design the retaining bolt thus provided can simply slide in the longitudinal direction and a single spring constantly urges said bolt in engagement with ramp or cam faces provided on the registering end of the movable plate in order to hold this plate against movement in its normal position. However, in case of major torsional or stretching efforts, the movable plate can pivot or tilt, thus pushing back the retaining bolt.

In other devices of the same type, the retaining bolt is adapted to pivot in all directions due to the provision of a ball and socket device, a single spring constantly urging said bolt to its normal position while permitting its pivotal movement in the desired direction when abnormal efforts are exerted.

However, in both cases the solution thus proposed is not fully satisfactory for it requires that the resilient force counteracting the plate release differs considerably according as the release movement is a rotational one or an upward or lifting movement, for instance in case of forward or backward fall. In fact, in the first case the resistance should be considerably lower than in the second case, in a ratio which may for example be of the order of 1 to 3. Now this ratio must remain unchanged irrespective of the "hardness" of the setting or adjustment of the mechanism.

Besides, in case of rotational release the resilient retaining mechanism must remain in operative engagement with the movable plate during the longest possible stroke, before the plate is actually released. In fact, if the torsional effort having caused this movement remains of limited value and is exerted only during a reduced or limited time period, the resilient mechanism can still restore the ski boot to its normal skiing position without fully releasing it.

This will avoid too frequent untimely releases of the ski boot. Therefore, this will also deter the users from making too "hard" or tight settings, which might prove very dangerous in actual practice.

To meet these various requirements, certain known ski bindings of the type considered herein are so designed that the two type of movements likely to be performed by the movable bolt are checked or controlled by two separate resilient mechanisms capable of exerting resilient resistances of respective different values against the rotational release and the upward extension release, respectively. However, these known mechanisms are particularly complicated and therefore expensive.

SUMMARY OF THE INVENTION

In view of the foregoing, it is the essential object of the present invention to provide a safety ski binding of the same general type wherein resilient resistances of different rational values are exerted against the two types of movements by means of a particularly simple and economical mechanism operating with the maximum reliability. This mechanism is also designed with a view to provide a relatively long follower stroke of the movable plate during its rotational release.

For this purpose, the present invention is directed to provide a safety ski binding of the type set forth hereinabove, wherein the retaining bolt is movable in the longitudinal direction and urged by spring means against an inclined ramp formed at the corresponding end of the movable plate, this ski binding being characterised in that said retaining bolt is carried by a support mounted for rotation about a pivot pin extending at right angles to the top surface of the ski, said support, also adapted to move in the longitudinal direction, being furthermore prevented from rotating by a piston resiliently urged against a cam member, one of said piston and cam member being associated with the pivoting support while the other, piston or cam member, is fixed, or vica versa.

According to a specific form of embodiment of this invention, the resilient piston urging the bolt support to its normal position is slidably mounted in a fixed case and the cam member engaged by said piston is carried by said support.

However, in a modified form of embodiment the same resilient piston is mounted within the support of said movable retaining bolt and the cam member engaged by said piston is carried by a fixed case rigid with the ski.

In either form of embodiment a fixed pivot pin permitting the swivel movements of the movable plate may be provided or not. Besides, the resilient device comprising said retaining bolt may be disposed either at the toe end or at the heel end of the binding.

Other features and advantages of these two forms of embodiment will appear during the following description given with reference to the attached drawings by way of example, not of limitation. In the drawings:

DESCRIPTION OF THE PREFERRED EMBODIMENTS

Figure 1:
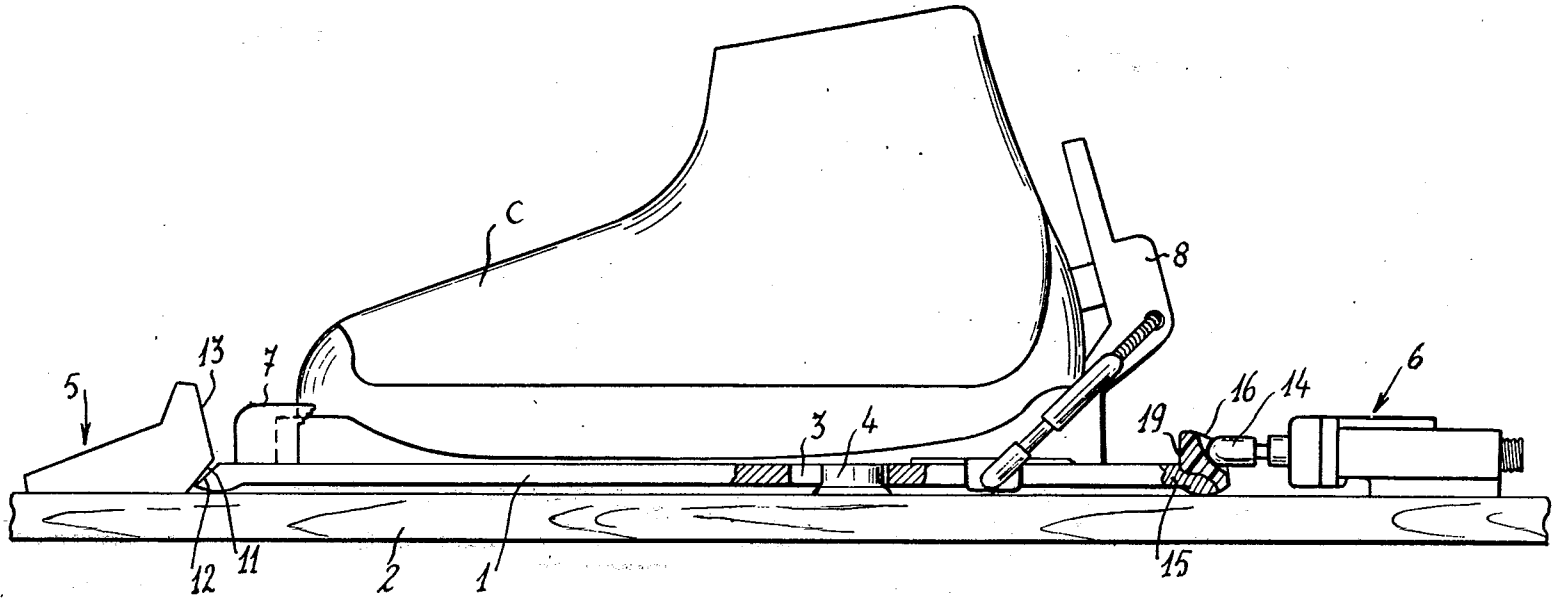
FIG. 1 is a side elevational view with parts broken away showing a first form of embodiment of the safety ski binding of this invention.

Referring first to the form of embodiment shown in FIGS. 1-5 of the drawings, the safety ski binding according to this invention comprises a movable plate 1 detachably mounted on the top surface of the ski 2. Intermediate its ends this plate 1 has formed therethrough a hole 3 permitting the passage of a pivot pin 4 secured to the ski. Preferably, this pivot pin 4 is located substantially in alignment with the skier's leg. With this arrangement, the plate 2 can pivot on the ski about the fixed pivot pin 4 in a plane parallel to the top surface of the ski. Said plate 1 can also be released completely from the ski by lifting its toe end or its heel end in relation to the ski surface, or through any other movement away from the ski.

However, this movable plate is normally held on the ski top by a pair of retaining devices disposed at the toe end and heel end, respectively, of the plate and designated in general by the reference numerals 5 and 6. On the other hand, the toe and heel ends of this movable plate 1 are provided with means for holding thereon the corresponding ski boot C. Thus, at the front, a jaw 7 adapted to grip the toe end of the boot may be provided. At the rear, the plate 1 may be associated with a heel hold-down device comprising for example a retaining lever 8 pivoted to a bow-shaped bracket 9 passing around the heel of the ski boot. The ends of this bow-shaped bracket are pivotally mounted in a base plate 10 rigidly secured to the rear end of plate 1. However, the longitudinal position of this base plate 10 may be adjusted in relation to the main movable plate 1 for example by means of a series of notches 10*a*. The toe-end retaining device 5 may advantageously be of the type disclosed in the U.S. Patent application Ser. No. 651,570 filed by the Applicant on Jan. 22, 1976, for "Safety Ski Binding". Therefore, this device consists of a fixed abutment member secured to the ski and having at the lower portion of its rear end a recessed inclined surface 11. This surface 11 extends across the ski and is adapted to retain in position the toe end of the movable plate 1 provided for this purpose with a matching inclined surface 12.

Above the retaining surface 11 the rear face of abutment member 5 comprises another inclined surface 12 directed upwardly and forwardly, for the purpose of facilitating the engagement of the front end 12 of movable plate 1 under the retaining surface 11.

The heel end retaining device 6 comprises a movable bolt 14 adapted to hold in position the registering end 15 of plate 1. The front end of this bolt is of rounded, for example semi-spherical configuration, and engaged in a recess or notch 16 formed at the rear end of plate 1. This recess constitutes somewhat a slideway extending longitudinally and is open at its rear end.

Figure 2:
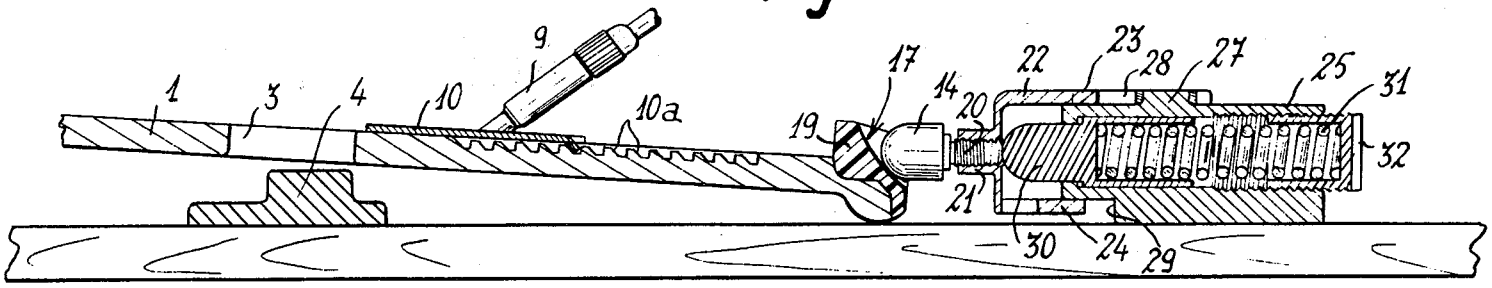
FIG. 2 is a fragmentary vertical section showing either the fitting of the movable plate on the ski, or the vertical release of said movable plate in case of backward fall of the skier.

Moreover, the bottom of this slideway 16 is provided with a ramp 17 inclined at a sharp angle rearwardly and downwardly, as clearly shown in FIG. 2. On either side of this ramp 17 are a pair of lateral vertical faces 18 (FIG. 5) engaged by the rounded end of retaining bolt 14 when the latter is in its operative position. This slideway is formed preferably in a molded plastic member 19 constituting an insert fastened to the rear end 15 of movable plate 1.

The retaining bolt 14 is carried by a screw-threaded shank 20 engaging a tapped end piece 21 formed at one end of a rotatable support 22, which altogether carry said bolt. Thus, the useful projecting length of this bolt 14 may be adjusted by screwing in or out its screw shank 20. Said rotatable support 22 includes two unequal horizontal and superposed flanges 23 and 24, and is mounted on a pivot pin 27 extending at right angles to the top surface of the ski 2. This pivot pin 27 is carried in turn by a fixed case 25 adapted to be secured by means of screws 26 to the ski top. This pivot 27 projects from the upper surface of case 25 and engages an elongated aperture 28 formed in the upper flange 23 of support 22.

More particularly, this elongated aperture 28 has its major dimension oriented in the longitudinal direction in order to afford a certain mobility of said support 22 in this direction, as will be explained more in detail presently. The lower flange 24 of support 22 is simply mounted in a notch 29 formed in the lower portion of case 25, thus preventing any upward movement of said support 22 when efforts are exerted thereagainst.

The resilient mechanism associated with the movable retaining bolt 14 comprises a piston 30 slidably mounted in a longitudinal bore of case 25 and projecting from the front end thereof. This piston is responsive to a coil compression spring 31 also housed in said bore and adapted to have its prestress adjusted by screwing a reaction screw plug 32 in one or the other direction.

Figure 3:
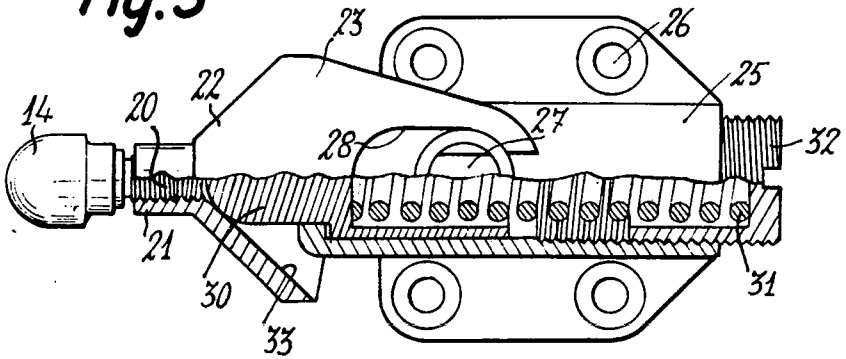
FIG. 3 is a partly a horizontal section and partly a plan view from above of the retaining device associated with the heel end of the binding.

The front end of piston 30 engages a shaped cam member consisting of the inner surface of the bottom of the rotary support 22. On either side of the longitudinal axis of said support 22 this cam member comprises two V-shaped or diverging cam faces 33 having their apex directed forwards. The force of spring 31 constantly urges said piston 30 against the hollow formed by said cam faces 33, as shown in FIG. 3. Thus, the rotary support 22 is kept in its normal position, in which its longitudinal axis is parallel or coincident with the longitudinal center line of the ski. However, at the same time this support 22 and the movable retaining bolt 14 are urged to their foremost projecting position, still under the force of spring 31.

To secure the movable plate 1 on the ski 2 it is first necessary to engage the slideway 16 formed at the rear end of said plate 1 under the retaining bolt 14, as shown in FIG. 2, the front end of said plate being pressed against the engagement inclined face 13 formed on the front or toe jaw 5. Then, the exertion of a downward pressure on the front end of plate 1 will tend to cause this end to slide until its inclined surface 12 engages underneath the retaining surface 11 of said jaw.

As a consequence of the initial backward movement of plate 1, the inclined ramp 17 of slideway 16 drives the movable bolt 14 and its support 22 backwards against the resistance of spring 31 transmitted via piston 30. When the front end 12 of movable plate 1 passes inclined face 13, it engages the retaining face 11 of its retaining device 5, and the spring 31 restores the movable bolt 14 to its forward normal position, i.e. the position illustrated in FIG. 1, in which it engages the inclined ramp 17 of slideway 16, between the two lateral faces 18 thereof.

In this position, the bolt 14 holds plate 1 against motion:

on the one hand, in the vertical direction, thus preventing the lifting of its rear end, due to its engagement with the ramp 17 of slideway 16, on the other hand, against rotation, by preventing same from rotating about the pivot pin 4 since said bolt 14 is retained laterally by the pair of registering side faces 18 of the rear slideway.

Figure 4:
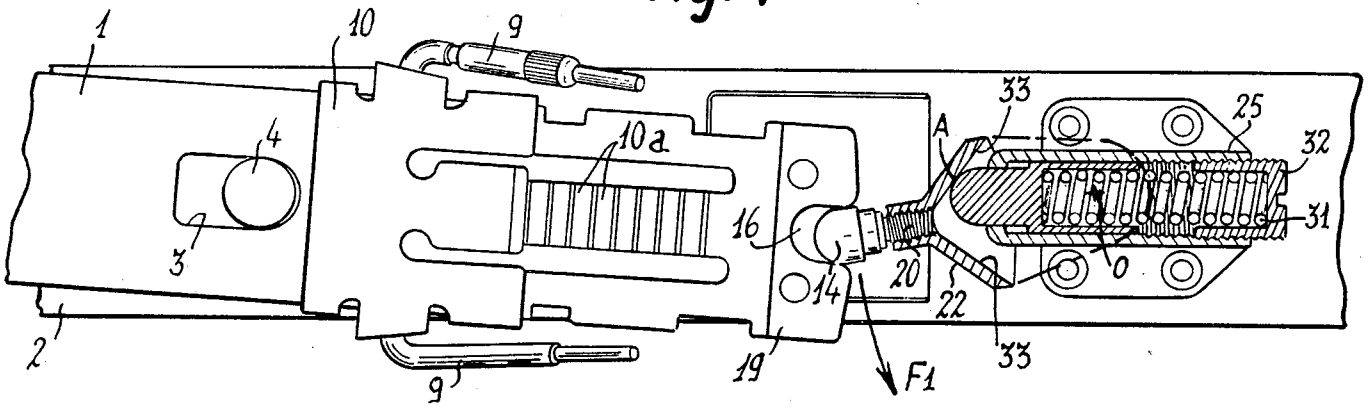
FIG. 4 is a fragmentary plan view from above with parts broken away, showing the movable plate of this ski binding during its rotational release.

However, if abnormal lateral stresses are exerted on the skier's leg, they will tend to rotate the movable plate 1 about pivot pin 4, as shown in FIG. 4. In this case, the retaining bolt 14 will pivot with its support 22, for example in the direction of the arrow $F_1$, about pivot pin 27 carried by the fixed case 25. During this movement, one or the other internal faces 33 of the cam member 22 will slide in engagement with piston 30, thus pushing this piston 30 back against the force of compression spring 31.

The above-described mechanism will then accordingly exert a resilient force the value of which depends not only on the pressure of spring 21 but also on the contour of ramps 33 and the length of the effective lever arm OA through which the resilient mechanism actuates the support 22 carrying the retaining bolt, the point O corresponding to the fulcrum point of said support while the point A corresponds to the point of contact between piston 30 and ramp 33.

It may also be pointed out that a relatively long stroke is available during which the movable retaining bolt 14 follows the movable plate 1 before the latter is fully released during its rotational movement. The substantial length of this stroke is due to the fact the bolt 14 is carried by the rotatable support 22 whose pivot axis O lies in the rear portion thereof. Thus, the device according to this invention is capable of meeting one of the essential requirements for a proper operation of the ski binding when the plate 1 is released as a consequence of a rotational movement.

Figure 5:
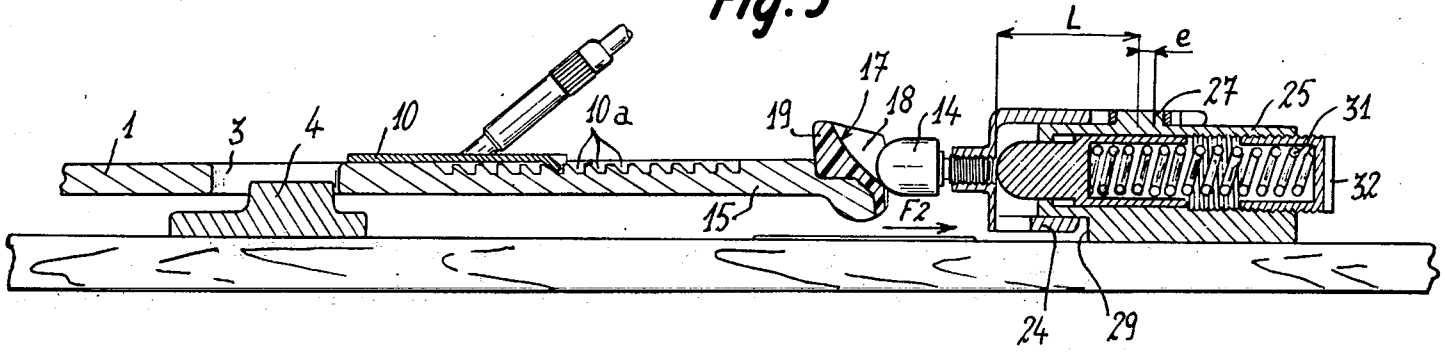
FIG. 5 is a view similar to FIG. 2 showing the vertical release of the movable plate in case of forward fall of the skier.

If the skier's leg is exposed to an effort or force tending to stretch the same upwards, for example as a consequence of a forward fall, the rear end of movable plate 1 will tend to move off the ski, as shown in FIG. 5. In this case the inclined ramp 17 of slideway 16 will force the bolt 14 rearwardly as shown by the arrow $F_2$. This movement is permitted by the elongated shape of aperture 28 of support 22 engaging pivot pin 27. In fact, this specific shape of aperture 28 enables the bolt support 22 to recede together with bolt 14 until the rear end 15 of plate 1 is released from said bolt 14.

In the event of a backward fall, the front or toe end 12 of movable plate 1 can release itself by disengaging its inclined surface 12 from the inclined surface 11 of toe jaw 5. However, this disengagement cannot take place unless the plate 1 recedes and therefore drives the bolt 14 backwards so that the mode of operation is substantially the same as in the preceding case.

Although the device of this invention utilizes only a single spring, namely spring 31, it is capable of developing different resilient forces against on the one hand a lateral rotary movement and on the other hand a lifting movement. In fact, a predetermined lower resistance may be obtained against movements of rotation in accordance with the contour of the cam faces 33 of rotary support 22, and modifying, as required, the lever arms involved.

As already mentioned hereinabove, the original design of the improved safety ski binding according to this invention is such that a relatively long stroke of the retaining bolt following the movable plate during the release thereof is obtained, against a resilient force of substantially constant value. Thus, frequent untimely releases are safely avoided. Another advantage of this device is that the users are prevented from resorting to excessively "hard" adjustments.

Another essential feature characterising this invention resides in its specific mode of operation in the event of a compound movement. In fact, considering a torsion movement occurring while the skier's leg is already stretched under another force, the device will assume for instance the position illustrated in FIG. 5. Now in this case the support 22 of the movable retaining bolt 14 has already been forced backwards, so that a relative movement has already taken place with respect to pivot pin 27 which was thus moved through a distance such as e within the elongated aperture 28 (see FIG. 5).

Consequently, the distance L between the pivot axis or fulcrum of support 22 and the point of contact between the piston 30 and cam face 33 is reduced accordingly. This will therefore reduce the length of the lever arm through which the resilient mechanism reacts on the rotary support 22 to prevent same from rotating.

Therefore, this lever arm reduction will at least partially compensate the increased resistance due to the compression of spring 31 caused by the backward movement of support 22 which results from the lifting of movable plate 1. In fact, if this effect did not occur an increased resilient resistance would be exerted against a rotation of said plate 1, thus creating the possibility of preventing the rotational release of this plate with all the serious inconveniences that would arise therefrom.

Now, with the present invention this drawback is removed since the treatment in the resilient resistance of spring 31 is somewhat compensated by a reduction in the lever arm L.

Figure 6:
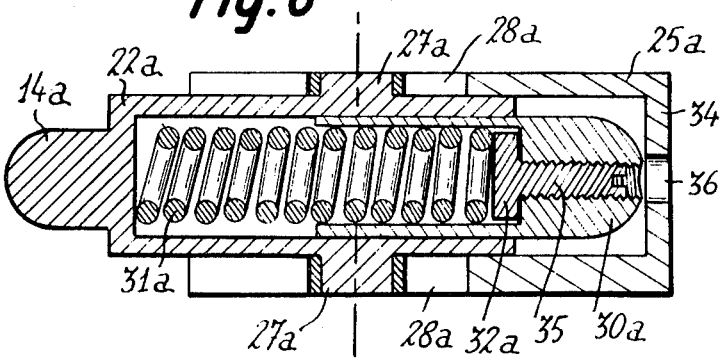
FIG. 6 is a vertical section showing a modified form of embodiment of the retaining device disposed at the rear or heel end of the ski binding.
Figure 7:
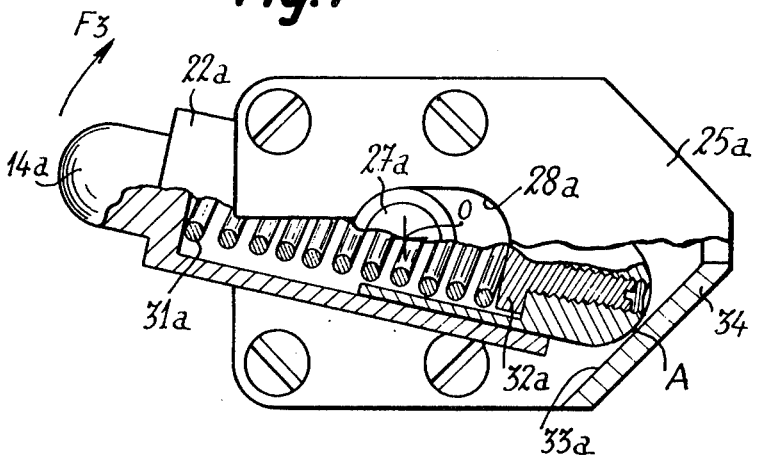
FIG. 7 is partly a plan view from above and partly a horizontal section of the device of FIG. 6 during the rotational release of the movable plate.
Figure 8:
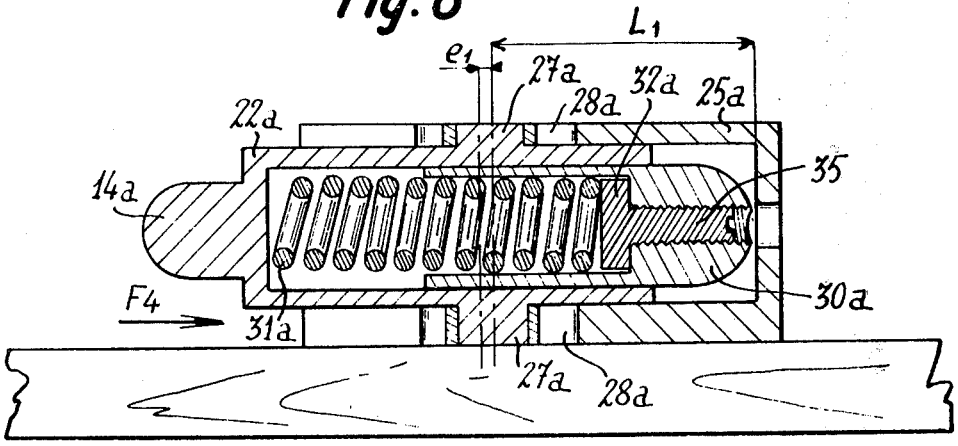
FIG. 8 is a view similar to FIG. 6 showing the backward movement accomplished by the retaining bolt either during the fitting of the movable plate in position or during a vertical release thereof in case of forward or backward fall of the skier.

FIGS. 6 to 8 inclusive illustrate another form of embodiment of the resilient retaining device provided at the heel end of movable plate 1. In this modified structure the retaining bolt **14*a* is carried by a support 22*a* which, like the support 22 of the preceding form of embodiment, is mounted for rotary and sliding movement in relation to a fixed case 25*a* secured to the top surface of the ski. In this example, a substantial portion of the movable support 22*a* extends within the fixed case 25*a* and carries a pair of trunnions 27*a*** engaging a pair of elongated holes 28*a* formed in the upper and lower walls of said case.

On the other hand, in comparison with the preceding form of embodiment the relative arrangement of the cam section of the support and of the piston engaging said cam section is inverted. In fact, in the example shown in FIGS. 6–8 the piston 30*a* is slidably mounted inside the movable support 22*a* and projects from the rear end thereof, the corresponding spring 31*a* being housed in said support. The cam engaged by this piston 30*a* is formed on the inner surface of the end 34 of said fixed case 25*a*. As illustrated, this cam comprises two divergent ramps 33*a* forming a V-shaped surface having its apex directed to the rear in this example.

The prestress of spring 31*a* is adjusted by means of a bearing member 32*a* disposed within the bore of piston 30*a* and engaged by the rear end of spring 31*a*; this member 32*a* comprises an integral screw-threaded shank 35 engaging a matching tapped hole extending through the bottom of piston 30*a*. An aperture 36 is provided through the bottom 34 of case 25*a* to permit an easy access to said screw-threaded shank 35 for adjustment purposes.

The above-described device operates like the preceding one, not only for fastening initially the movable plate 1 to the ski top but also for releasing this plate either by rotation or by lifting, of a combination of these two movements.

In the case of a torsional movement, the support 22*a* of retaining bolt 14*a* tends to rotate about its trunnions 27*a*, as shown by the arrow $F_3$ in FIG. 7, the piston 30*a* thus sliding against one or the other ramp 33*a* in order to develop a resilient force counteracting the rotation of movable plate 1. As in the preceding example, a relatively long stroke enables the movable retaining bolt 14*a* to follow this plate 1, before the latter is released completely.

In the case of a movement tending to lift the heel end of plate 1, the ramp 17 of the rear slideway 16 of said plate causes the retaining bolt 14*a* to recede as shown by the arrow $F_4$ (FIG. 8) against the resistance of spring 31*a* reacting against piston 30*a* bearing in turn against cam 33*a*. Thus, the trunnions 27*a* are caused to slide backwards in the longitudinal direction, in the elongated holes 28*a* formed through the lower and upper walls of case 25*a*, until said ramp 17 of slideway 16 escapes from retaining bolt 14*a*.

As in the preceding case, the rotational and lifting releases take place in a definitely different manner, and the resilient resistances also have very different values. On the other hand, there is a relatively long follower stroke in case of rotational release.

Finally, in case of a compound movement, the increment in the resistance caused by the spring compression as a consequence of the backward movement of bolt 14*a* is at least partially compensated by a reduction in the lever arm through which the resilient mechanism tends to counteract the rotation of support 22*a*. In fact, in this case the backward movement e of trunnions 27*a* reduces the length of lever arm $L_1$, since said trunnions will move towards cam 33*a* engaged in turn by piston 30*a* (see FIG. 8).

Therefore, though the present device comprises a particularly simple mechanism, it provides the same advantages as certain known ski bindings comprising two separate resilient mechanisms for controlling or checking the release of the movable plate in case of rotation thereof, and the release of this movable plate in case of lifting thereof. Of course, this simplification of the mechanism entails an appreciable reduction in the cost of the device and also a reduction in weight which constitutes likewise a particularly advantageous feature of the present invention.

However, it will be readily understood that this ski binding should not be construed as being strictly limited by the two specific forms of embodiment shown and described herein by way of illustration.

Thus, the movable plate may be detachably mounted on the ski, without providing the solid pivot pin 4 as contemplated in the preceding examples. Nevertheless, in case of torsion stress, this plate could accomplish as in said examples various movements of rotation in a plane parallel to the ski. However, when no solid pivot pin is contemplated on the ski, the arrangement of the toe and heel retaining devices 5 and 6 may advantageously be inverted, the fixed abutment member 5 being disposed at the rear and the resilient device 6 at the front.

Figure 9:
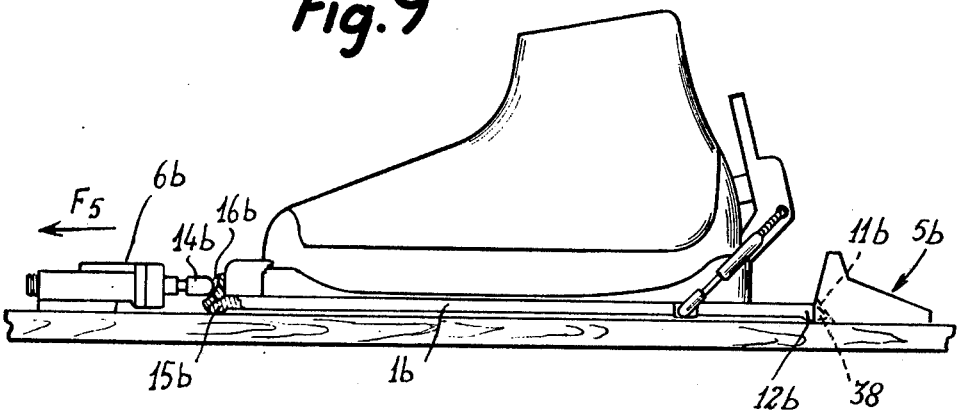
FIG. 9 is a side elevational view showing a modified form of embodiment of the ski binding according to this invention.
Figure 10:
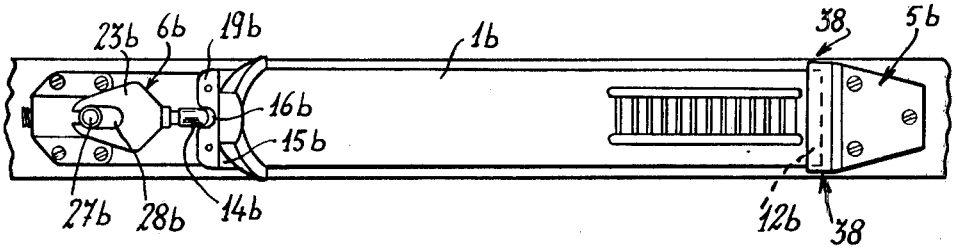
FIG. 10 is a plan view from above of the device shown in FIG. 9.
Figure 11:
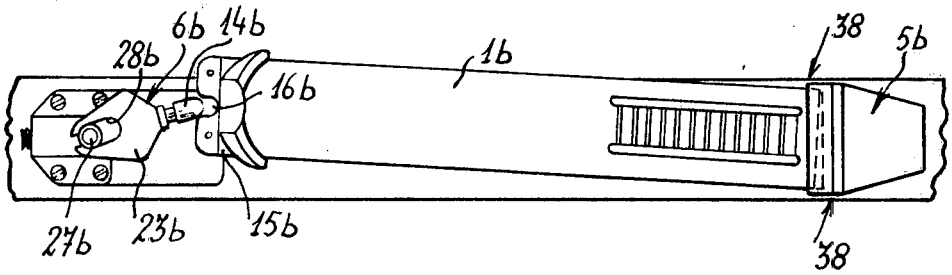
FIG. 11 is a similar view showing the rotational release of the movable plate incorporated in this ski binding.

FIGS. 9 to 11 illustrate diagrammatically a typical embodiment of a ski binding having this inverted construction.

In this example, no solid pivot pin is provided for the corresponding movable plate 1*b*. On the other hand, the toe end 15*b* of this plate 1*b* is retained on the ski top by a device designated generally by the reference symbol 6*b*, which is similar to the device 6 disposed at the rear or heel end of the plate in the embodiment illustrated in FIGS. 1 to 5. In fact, this device comprises a movable retaining bolt 14*b* having its rounded operative end engaged in a slideway 16*b* formed in the front or toe end 15*b* of movable plate 1*b*. This slideway 16*b* is the same as that 16 of the form of embodiment shown in FIGS. 1 to 5 of the drawings, and is also formed in an insert 19*b* solid with the toe end of movable plate 1*b*.

The resilient mechanism of retaining device 6*b* is exactly the same as the one contemplated in the form of embodiment shown in FIGS. 1 to 5; therefore, a detailed description thereof is not deemed necessary for a proper understanding of this invention. However, it may be reminded that the retaining bolt 14*b* is carried by a support 23*b* rotatably mounted on a pivot pin 27*b* engaging an elongated aperture 28*b* formed in the upper wall or flange of said support.

The retaining device provided at the heel end of plate 1*b* comprises a fixed abutment member 5*b* similar to the abutment member 5 of the embodiment shown in FIGS. 1 to 5. However, the rear edge 12*b* of plate 1*b* is normally engaged in a recess formed in the front portion of this abutment member 5*b* and this recess is bounded on either side by end walls 38 adapted to retain the aforesaid rear edge 12*b* in position by it sides. However, outside this modification, the arrangement of said fixed abutment member 5*b* is the same as that of abutment member 5 contemplated in the form of embodiment illustrated in FIGS. 1 to 5.

Therefore, the mode of operation of the modified construction shown in FIGS. 9 to 11 is substantially the same. Besides, FIG. 11 shows the movable plate 1*b* durng its release due to a rotational movement. Of course, during this movement, a relatively long follower stroke can take place between the retaining bolt 14*b* and the toe end 15*b* of movable plate 1*b*.

On the other hand, the resilient resistance provided by the present device in case of rotational release differs completely from the resistance obtained in case of toe or heel lifting movement of said plate.

In fact, in case of plate lifting movement, for instance when a forward fall occurs, this plate is released due to the presence of the ramp formed on the rear end **12*b* of movable plate 1*b*. In this case, this ramp will slide against the inclined retaining surface 11*b* of said fixed abutment member 5*b*, thus causing a forward movement of the movable plate and therefore a likewise forward movement of the retaining bolt 14*b*, as shown by the arrow $F_5$, against the force of the spring incorporated in the resilient device 6*b*. This movement continues until the end 12*b* of movable plate 1*b* can escape from the inclined retaining surface 11*b***.

It may be noted that in case of compound movement, i.e. when the skier's leg is subjected simultaneously to a torsional stress and to a certain degree of stretching, the support **23*b* of retaining bolt 14*b* is rotated when said support has already accomplished a certain forward movement (arrow $F_5$). Therefore, the position of pivot pin 27*b* within aperture 28*b* is then modified, this implying a reduction in the length of the lever arm through which the resilient mechanism exerts a resistance against the rotational movement of said support 23*b***. Under these conditions, it is clear that this modified form of embodiment provides the same advantages and results as those derived from the preceding forms of embodiment.

Of course, various modifications and changes may be brought to the shapes, relative sizes and proportions of the component elements of the devices shown and described herein, without departing from the basic principles of the invention as recited in the following claims.

What is claimed as new is:

1. A safety ski binding comprising a movable plate adapted to be clamped to an appropriate ski boot, means detachably securing the respective ends of said plate to a ski, said means comprising means on one end of said plate forming a longitudinally recessed downwardly extending ramp extending away from said plate end, and means for securing the recessed end of said plate to said ski comprising a bolt engageable with said recess, means supporting said bolt for both longitudinal and pivotal movement with respect to said ski, means mounting said bolt supporting means on the ski and means on said supporting means and said mounting means for urging said bolt into said recess and simultaneously resisting pivotal movement of said supporting means, said last means including a slidable piston mounted on one of said bolt supporting means and said mounting means, means on the other of said bolt supporting means and said mounting means engageable by said piston and forming a camming surface on either side thereof having inwardly directed, vertically extending walls, and a single spring simultaneously urging said bolt into said recess against said ramp, whereby lifting of the recessed end of said plate from said ski causes said ramp to press said bolt against the resistance of said spring, the contour of said ramp thus determing the resilient resistance counteracting the lifting movement of the one end of said plate, and also urging said pistion against the inwardly directed walls of said camming surface, whereby the contour of the latter determines the value of the resilient resistance countering the pivotal movement of said bolt supporting means.

2. Safety ski binding according to claim 1, in which said mounting means includes a casing mounted on said ski, enclosing said piston and said spring, provided with a vertical pivot pin, and a forward opening though which said piston projects, and said bolt supporting means comprises a rotary support mounted on said pivot pin, said camming surface being formed on said rotary support in contact with said projecting piston, and means mounting said bolt on said rotary support and in contact with said ramp.

3. Safety ski binding according to claim 2, in which said rotary support is provided with an elongated aperture about said pivot pin, whereby said rotary support and the bolt carried thereby are longitudinally movable against the action of said spring.

4. Safety ski binding according to claim 2, in which said rotary support comprises a pair of horizontally spaced flanges connected by a vertical wall forming said camming surface and in which the upper of said flanges is formed with an elongated aperture about said pivot pin, and in which said casing is provided with a notched opening for receiving the lower of said flanges.

5. Safety ski binding according to claim 1, in which the means engageable by said piston is positioned on said bolt supporting means between said piston and said bolt whereby said spring acts on said bolt through said piston.

6. Safety ski binding according to claim 1, in which said mounting means comprises a casing mounted on said ski having a rear inner surface consisting of said vertically extending walls, and said bolt supporting means comprises a rotary support pivotally mounted within said casing, and supporting said bolt at its front end and slidably supporting said piston at its rear end, and in which said spring is positioned between said bolt and said piston for urging the former into engagement with said ramp and the latter into engagement with said vertically extending walls.

7. Ski binding according to claim 6, in which said rotary support is provided with upper and lower vertical trunnions and said fixed casing includes a pair of horizontally spaced forwardly extending flanges juxtaposed to the respective upper and lower surfaces of said rotary support, said flanges being respectively provided with elongated apertures about said vertical trunnions

8. Safety ski binding according to claim 1, in which the means engageable by said piston is positioned rearwardly thereof and means mounting said spring between said bolt and said piston whereby said spring urges said bolt forwardly and said piston rearwardly.

* * * * *